United States Patent [19]

Hirooka et al.

[11] Patent Number: 4,517,271

[45] Date of Patent: May 14, 1985

[54] ELECTROPHOTOGRAPHIC CDS PHOTOSENSITIVE MEMBER WITH ACRYLIC RESIN BINDER

[75] Inventors: Masaaki Hirooka, Toride; Keiji Kubo, Kawasaki; Toshiyuki Yoshihara, Mitaka, all of Japan

[73] Assignee: Canon Kabushiki Kaisha, Tokyo, Japan

[21] Appl. No.: 583,799

[22] Filed: Mar. 1, 1984

Related U.S. Application Data

[63] Continuation of Ser. No. 384,609, Jun. 3, 1982, abandoned.

[30] Foreign Application Priority Data

Jun. 12, 1981 [JP] Japan ..... 56-90456
Jun. 15, 1981 [JP] Japan ..... 56-91880

[51] Int. Cl.[3] ..... G03G 5/087
[52] U.S. Cl. ..... 430/94; 430/96
[58] Field of Search ..... 430/94, 96

[56] References Cited

U.S. PATENT DOCUMENTS

| | | | |
|---|---|---|---|
| 3,508,961 | 4/1970 | Makino et al. | 430/94 X |
| 3,649,263 | 3/1972 | Tubuko et al. | 430/96 |
| 4,105,448 | 8/1978 | Miyatuka et al. | 430/94 X |
| 4,252,883 | 2/1981 | Komura et al. | 430/94 X |
| 4,335,195 | 6/1982 | Nishigaki et al. | 430/96 X |

FOREIGN PATENT DOCUMENTS

| | | | |
|---|---|---|---|
| 805616 | 2/1969 | Canada | 430/96 |

*Primary Examiner*—Roland E. Martin
*Attorney, Agent, or Firm*—Fitzpatrick, Cella, Harper & Scinto

[57] ABSTRACT

An electrophotographic photosensitive member has a photoconductive layer composed of cadmium sulfide bonded with a binder resin which is an acrylic resin having a glass transition point of 15° to 70° C. and an acid value of 10–40.

6 Claims, 7 Drawing Figures

ELECTROPHOTOGRAPHIC CDS PHOTOSENSITIVE MEMBER WITH ACRYLIC RESIN BINDER

This application is a continuation of application Ser. No. 384,609 filed June 3, 1982, now abandoned.

BACKGROUND OF THE INVENTION

1. Field of the Invention

This invention relates to electrophotographic photosensitive members and more particularly to an electrophotographic photosensitive member improved in the stability of performance characteristics by employing an acrylic resin having a specific glass transition point and acid value, as a binder resin for forming its photoconductive layer.

2. Description of the Prior Art

Electrophotographic photosensitive members adopt various constructions in order to obtain desirable characteristics or to meet varieties of electrophotographic processes applied. One of the representative constructions has a photoconductive layer, as an image retaining layer, on a substrate; another one is provided with a photoconductive layer, as an image retaining layer, on a substrate and with an insulating layer laminated on the photoconductive layer. These two constructions are widely adopted. Photosensitive members of the former construction are used for image formations according to the most popular electrophotographic process, i.e., the process comprising charge, image exposure, development, and if necessary, transfer. The insulating layer of the latter construction aims at protecting the photoconductive layer, improving the mechanical strength of photosensitive members, improving dark decay characteristics, or adapting photosensitive members for a specific electrophotographic process. Typical examples of photosensitive members having such an insulating layer or of electrophotographic processes employing these photosensitive members are described in U.S. Pat. No. 2,860,048, Japanese Patent Publication No. 16429 (1966), and U.S. Pat. Nos. 3,146,145, 3,607,258, 3,666,363, 3,734,609, 3,457,070, and 3,124,456.

An electrophographic process is applied to an electrophotographic photosensitive member to form electrostatic images, which are then developed to visualize.

Photosensitive members hitherto used have a tendency such that the dark area potential, light area potential, and intermediate area potential cannot have their respective constant values during repetition of charge and exposure or after the recess time, and the developed image densities (D max) are therefore labile. This is attributable to a light memory or charge memory produced in photosensitive members. These phenomena are largely affected by binder resins for use in bonding cadmium sulfide to form a barrier layer.

When a binder resin deficient in resistance or stability to light, humidity, or heat is used for bonding cadmium sulfide, the binder will adversely affect the stability of the resulting photoconductive layer forming material, thus often producing unstable photosensitive members, so that its use for the production of photoconductive layers is much restricted.

In particular, when a humidity-labile binder resin is used, repeated charges of the photosensitive member under high humidity conditions will cause the degradation of the photoconductive layer, thus raising the problem of durability or stability in a high humidity environment.

Meanwhile, the binder resin for this purpose is desired to have suitable properties as a binder, that is, a high ability to disperse cadmium sulfide, good coating workability so as to give a desired film thickness, strong adhesion to the substrate, and ability to give the photoconductive layer a good mechanical durability. A few sorts of binder resin have sufficiently satisfied electrophotographic performance characteristics of photoconductive layer and suitable properties as a binder, as a whole.

The environmental temperature is another factor causing variations in performance characteristics of photosensitive members. Many types of photosensitive member are liable to undergo an influence of temperature changes from low to high and in the reverse direction, thereby charge bearing characteristics thereof being deteriorated.

SUMMARY OF THE INVENTION

The primary object of this invention is to provide an electrophotographic photosensitive member capable of forming good images without fluctuation, in particular without being affected by high humidity conditions or by variations in surrounding temperature.

This invention provides an electrophotographic photosensitive member having a photoconductive layer composed of cadmium sulfide bonded with a binder resin, characterized in that said binder resin is an acrylic resin having a glass transition point of 15° to 70° C. and an acid value of 10 to 40.

BRIEF DESCRIPTION OF THE DRAWINGS

In FIGS. 1, 4 and 6, the "repeated charge" in the abscissa means "repeated charging and exposure".

DESCRIPTION OF THE PREFERRED EMBODIMENTS

Figure 1:
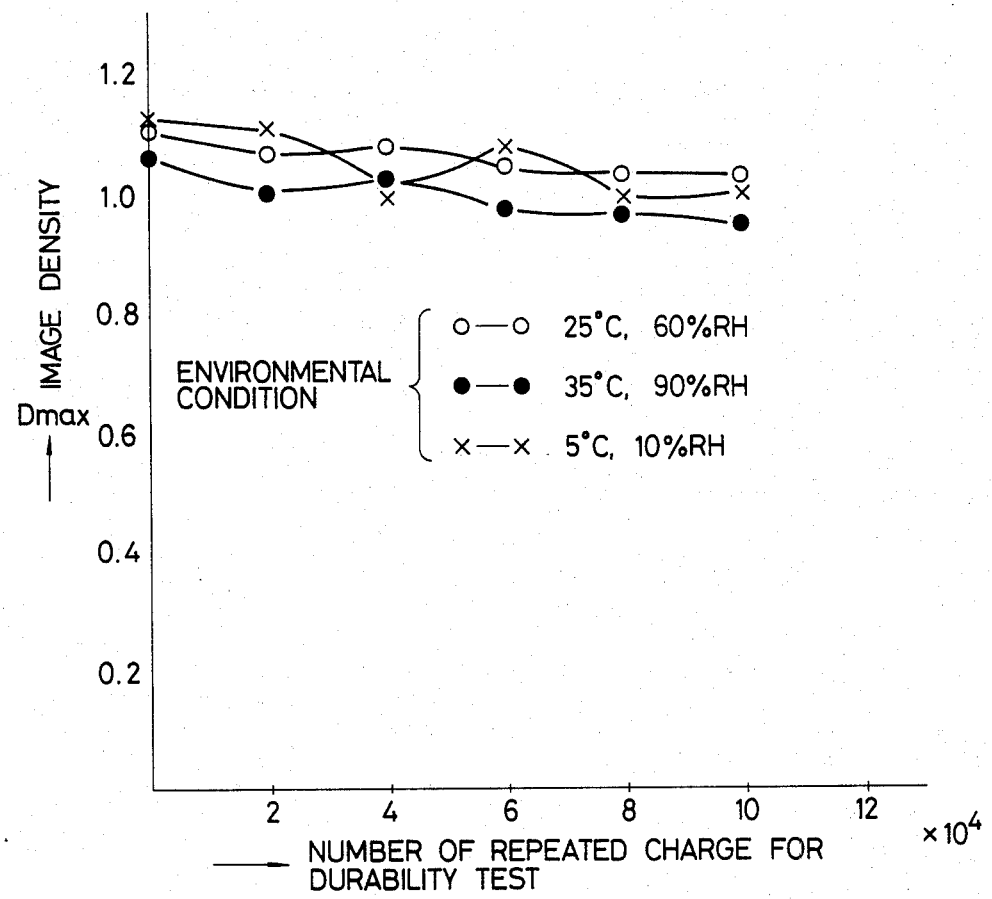
FIG. 1 is a graph showing image density variations with increasing number of repeated charging and exposure.

The acrylic resin used in this invention serves to reduce the memory effect of repeated charges on the photoconductive layer and thereby always ensure stable potentials to the photosensitive member.

The present acrylic resin is stable to heat, light, and humidity and hence effective for the preparation of a photoconductive layer and for improving the environmental resistance of a photoconductive layer, thus much contributing to its stability.

The present acrylic resin has a polar group, for example, —COOH group, and its content can be freely selected within a certain range so that cadmium sulfide can be satisfactorily dispersed therein and the resulting dispersion exhibits a good film forming property and coating workability.

Since this type of acrylic resin is prepared by solution polymerization, its molecular weight can be high enough to use it without adding any hardener, and it is sufficiently stable and easy to handle, for practical use.

The photoconductive layer of this invention is highly resistant to the degradation due to repetitions of charge and exposure under high humidity conditions, being excellent in durability under moist conditions. The durability of the present photoconductive layer depends upon the carboxyl content in the acrylic resin. The coating material employing an acrylic resin of low carboxyl content is inferior in dispersion of cadmium sulfide and tends to form an incomplete and nonuniform coating on each CdS particle. On the other hand, the coating material employing an acrylic resin of too high carboxyl content, though good in the dispersibility, is inferior in performance characteristics under moist conditions since the insulating properties of the resin itself is labile to moisture (such as reduction of resistivity).

The carboxyl content in the acrylic resin of this invention is chosen so that the acid value of resin (quantity expressed in mg. of KOH to neutralize 1 Kg of resin) may range from 10 to 40, preferably from 10 to 30.

Because glass transition points (Tg) of the acrylic resin used in this invention are 15° to 70° C., environmental temperature variation has no significant effect on characteristics of the photoconductive layer. Thus, the acrylic resin gives photosensitive members stable to temperature variation. The temperature effect on the photoconductive layer decreases with decreasing Tg of the acrylic resin.

The present acrylic resin is prepared by homopolymerization or copolymerization of monomer or monomers mainly composed of a soft component, that is, acrylate or methacrylate having an alkyl portion of four or more carbon atoms, such as, for example, n-butyl acrylate, isobutyl acrylate, 2-ethylhexyl acrylate, or n-octyl methacrylate, so as to give a glass transition point of 15° to 70° C. The Tg may be controlled by copolymerization with a hard component such as methyl acrylate, ethyl acrylate, methyl methacrylate, ethyl methacrylate, styrene and the like.

The Tg below 15° C. reduces the mechanical strength of the photoconductive layer while the Tg below 15° C. advantageously decreases accumulation of the memory effect of repeated charge. The Tg exceeding 70° C. results in much accumulation of the memory effect of repeated charges and instability in charge bearing characteristics of the photosensitive member, in other words, images obtained by repeating copying are different in quality from one another.

When an insulating layer is formed on the photoconductive layer, the Tg is preferred to be 40° C. or above in order that the acrylic resin may not be attached by the solvent used for coating of the insulating layer.

Further, in order to keep adhesion between the photoconductive layer and the substrate, the Tg is preferred to be 60° C. or below.

Accordingly, the molecular structure of the acrylic resin is particularly chosen so that the Tg may lie within the range of from 40° to 60° C.

An effective polar group in the acrylic resin molecule is —COOH group, and monomers for introducing —COOH group into the molecule include, for example, fumaric acid, itaconic acid, maleic acid, monoesters of these acids, acrylic acid, and methacrylic acid.

The acrylic resin can be synthesized with ease by the usual solution polymerization process, i.e., by polymerizing monomers as mentioned above in a solvent such as toluene, methyl isobutyl ketone, or xylene at 40° to 150° C. by using a polymerization initiator such as benzoyl peroxide, azobisisobutyronitrile, cumene hydroperoxide and the like.

The molecular weight of the present acrylic resin can be controlled by proper selection of the amount of polymerization initiator and other reaction conditions. Suitable number average molecular weights of the resin are at least 10,000, particularly 10,000 to 50,000 from the point of view of the sedimentation velocity of cadmium sulfide particles dispersed in a solution of the resin and further from the point of view of uniformity of the coating.

Suitable contents of the binder acrylic resin in the photoconductive layer are selected from the range of 0.5 to 50 parts per 100 parts of the photoconductive material, CdS, by weight, from the viewpoint of particle size and particle size distribution of CdS.

Thickness of the photoconductive layer is generally 5 to 100μ, preferably 10 to 50μ, though it depends upon the kind and properties of the photoconductive material. The electric resistance of the photoconductive layer in the dark is usually in the range of $10^{12}$ to $10^{14}$ Ω. cm.

In the case of photosensitive members provided with an insulating layer, the resin used for the insulating layer is suitably selected from various kinds of universal resins, including, for example, polyethylene, polyester, polypropylene, polystyrene, poly(vinyl chloride), poly(vinyl acetate), acrylic resin, polycarbonate, silicone resin, fluoroplastics and epoxy resin. Thickness of the insulating layer is generally within the range of 0.1 to 100μ, desirably 0.1 to 50μ.

Typical constructions of the photosensitive member according to this invention involve one comprising a substrate and a photoconductive layer laid thereupon and one comprising further an insulating layer laid on the photoconductive layer. The substrate is made from a material arbitrarily selected from plates of metals such as stainless steel, copper, aluminum, and tin, paper, plastic sheets and films, etc. While shape of the substrate is also selected as desired from cylindrical forms, belt forms, plate forms, etc., substrates of photosensitive members used for continuous high speed copying are desirable to have a endless belt form or cylindrical form.

Thickness of the substrate, though suitably chosen, is desired to be minimized, when flexibility is requested, as far as the substrate can sufficiently exhibit its function. In such cases, however, the thickness favorable is usually 10 to 50μ in aspects of substrate production, handling, and mechanical strength.

This invention will be illustrated further referring to the following Examples, wherein "parts" represents parts by weight.

Synthesis Example 1

An acrylic copolymer resin was prepared by feeding 150 parts of toluene into a 500-ml 4-necked flask equipped with a cooling tube, stirrer, and thermometer.

heating it to 110° C., adding styrene 40 parts, n-butyl methacrylate 40 parts, ethyl methacrylate 120 parts, methacylic acid 12 parts, benzoyl peroxide 4 parts, and toluene 60 parts spending 3 hours under an inert gas atmosphere, and further heating for 6 hours. This copolymer (designated as acrylic resin-A) was found to have nonvolatile matter content 49.5%, Tg 52° C., polymer acid value 15, and number average molecular weight 28,000.

Synthesis Example 2

A copolymer was prepared in the same manner as Synthesis Example 1 by using toluene 200 parts, ethyl methacrylate 70 parts, n-butyl methacrylate 116 parts, acrylic acid 10 parts, and 2,2'-azobisisobutyronitrile 5 parts. This copolymer (designated as acrylic resin-B) indicated nonvolatile matter content 52.2%, Tg 41° C., polymer acid value 22, and number average molecular weight 42,000.

Synthesis Example 3

The following acrylic resins were obtained in the same manner as Synthesis Example 1:

TABLE 1

| Acrylic resin | Monomer composition (parts) St | n-BMA | MA | EMA | MMA | Tg (°C.) | Acid value | Mol. wt. |
|---|---|---|---|---|---|---|---|---|
| C | 10 | 83 | 7 | | | 20 | 13 | 32000 |
| D | 10 | 36 | 7(A) | 36 | | 44 | 14 | 27000 |
| E | 20 | 20 | 2 | 28 | | 58 | 5 | 35000 |
| F | | 10 | 7 | | 73 | 98 | 13 | 29000 |
| G | | 70 | 2 | | 30 | 40 | 4 | 38000 |
| H | | 70 | 7 | | 30 | 42 | 12 | 31000 |
| I | | 70 | 10 | | 30 | 42 | 19 | 28000 |
| J | | 70 | 18 | | 30 | 44 | 29 | 25000 |
| K | | 70 | 10 | | 30 | 42 | 19 | 5000 |

Abbreviations:
St . . . Styrene
n-BMA . . . n-Butyl methacrylate
MA . . . Methacrylic acid
(A) . . . (Acrylic acid)
EMA . . . Ethyl methacrylate
MMA . . . Methyl methacrylate

EXAMPLE 1

A CdS powder (100 parts) and acrylic resin-A (40 parts) for its binder were dispersed by stirring and milled 3 times through a roll mill with a gap of 50μ. An Al cylindrical substrate was immersed in the above dispersion adjusted to have a viscosity of 200 mpa.s by adding toluene, then was drawn up therefrom at the rate of 100 mm/min, and dried at 100° C. for 15 minutes, to form a photoconductive layer of 35μ thick. A photosensitive drum was completed by winding a polyester film (the polyester layer itself being 25μ thick, and the polyester layer being coated with an adhesive of 5μ thick) around the resulting cylindrical photoconductive layer.

The photosensitive drum was tested by applying an electrophotographic process consisting of primary positive DC charge, secondary AC discharge simultaneously with imagewise exposure, blanket exposure, dry development with a negative toner, transfer, and cleaning treatment. The results are shown in Table 2 and FIG. 1.

This photosensitive drum indicated good durability withstanding 100,000 or more repetitions of charging and exposure in high humidity and low humidity environments. There were produced copies of consistent good image quality.

TABLE 2

| Environmental conditions | Number of repeated charge and exposure | Potential retention (%) | Image quality (cf. FIG. 1) |
|---|---|---|---|
| 25° C., 60% RH | $\geqq 1 \times 10^5$ | 95 | Indicating good stability |
| 35° C., 90% RH | $\geqq 0.7 \times 10^5$ | 87 | Indicating good stability |
| 5° C., 10% RH | $\geqq 1 \times 10^5$ | 95 | Indicating good stability |

EXAMPLE 2

A photoconductive layer of 38μ thick was formed by using acrylic resin-B on a cylindrical substrate in the same manner as Example 1. This photoconductive layer-coated cylinder was immersed in a hexane solution of a synthetic isoprene rubber (tradename: JSRIR 2200, mfd. by Japan Synthetic Rubber Co.) adjusted to a viscosity of 80 mpa.s with n-hexane, was drawn up therefrom at the rate of 150 mm/min, and dried at 70° C. for 15 minutes to form a clearcoling insulating layer of 10μ thick. Further, a light-curable epoxy acrylate resin (tradename: MUVC-Wo-4A, mfd. by Dainichi Seika Kogyo, containing methyl ethyl ketone) layer of 25μ thick was laid on said insulating layer in a similar way, thereby completing a photosensitive drum.

Durability tests were conducted under different environmental conditions on this photosensitive drum by the same electrophotographic process as used in Example 1. The photosensitive drum gave almost constant results showing no significant variation in its performance characteristics and in image quality.

EXAMPLE 3

In the same manner as Example 1, photoconductive layers were formed by using acrylic resins-C to K as binders. Each photoconductive layer-coated cylinder was inserted into a shrinkable poly(ethylene terephthalate) tube of 22μ in thickness (tradename: Nalophan, mfd. by Hoechst A.G.), which was then shrinked to adhere to the photoconductive layer by heating for 15 minutes at 110° C., thereby forming an insulating layer 20μ thick. Photosensitive drums C through K were prepared in this way.

On the other hand, similar photosensitive drums X, Y, and Z each having a CdS photosensitive layer were prepared as comparative samples using the following binder resins:

Comparative sample X: Vinyl chloride-vinyl acetate copolymer (containing maleic anhydride), tradename VMCH (mfd. by Union Carbide Corp.)

Comparative sample Y: Ester-modified silicone resin, tradename TSR 194 (mfd. by Toshiba Silicone Co.)

Comparative sample Z: Thermosetting acrylic resin (Tg≧100° C., curing conditions 150° C., 30 minutes), tradename SE5466 (mfd. by Mitsubishi Rayon Co.)

Figure 2:
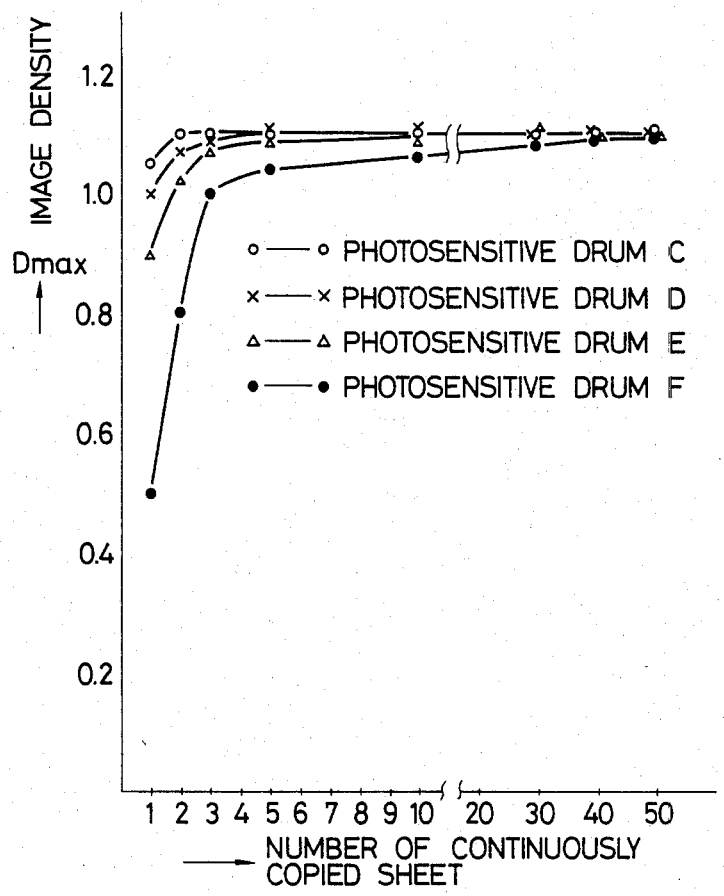
FIGS. 2 and 3 are graphs showing image density changes in continuous copying from restarting after interruption of repeated charge and exposure.
Figure 3:
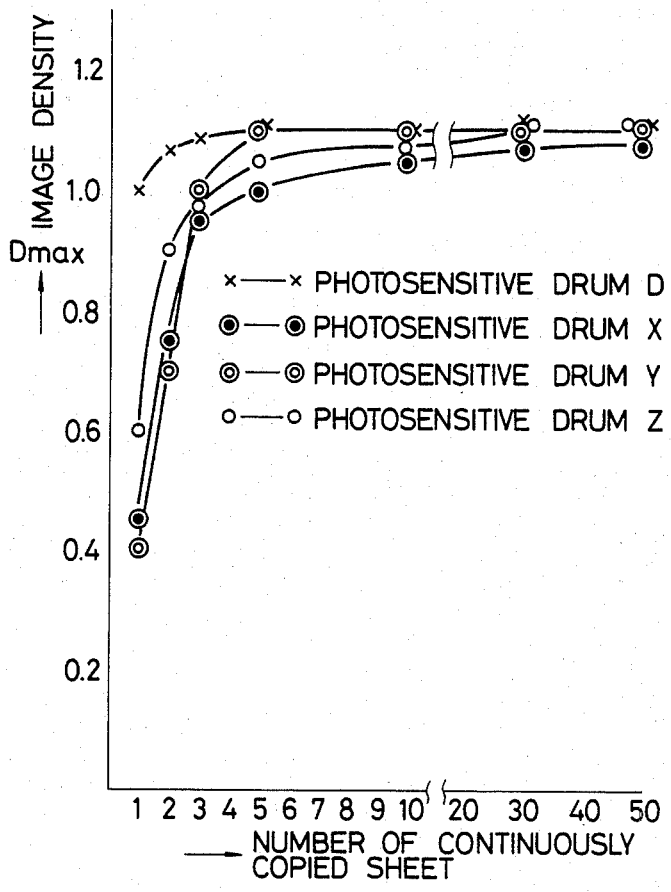

On these photosensitive drum C, D, E, F, X, Y, and Z, image density variations were measured during continuous copying from restarting after an interruption of repetition of charging. The results are shown in FIGS. 2 and 3.

Figure 4:
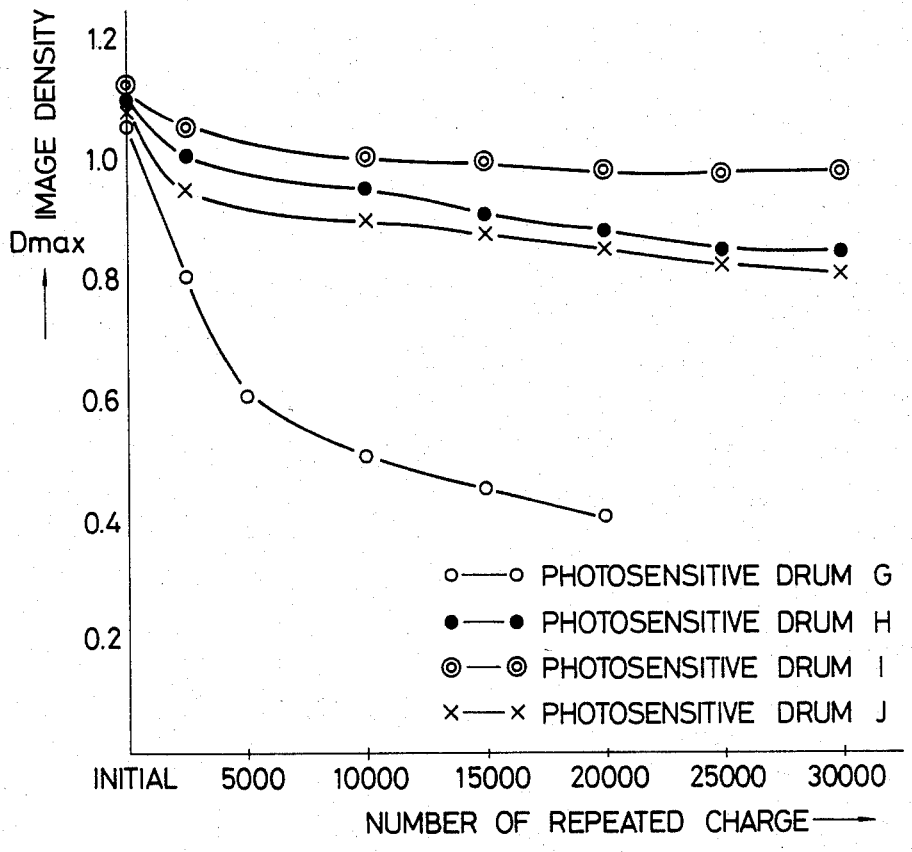
FIG. 4 is a graph showing image density changes when photosensitive drums are charged and exposed repeatedly in a high humidity surrounding.

Image density variations during 30,000 repetitions of copying (charging and exposure) were measured on photosensitive drums G, H, I, and J in a high humidity atmosphere of 90% RH at 35° C. The results (image density of 50th copy was measured) are shown in FIG. 4.

Results of evaluating image quality on the photosensitive drums C through K were shown in Table 3.

TABLE 3

| Drum | Image quality evaluation: At the start | After 30,000 repetitions of charging and exposure |
|---|---|---|
| C | o | 0* |
| D | o | o |
| E | X Nonuniform density | — |
| F | o | o |
| G | X Nonuniform density | — |
| H | o | o |
| I | o | o |
| J | o | o |
| K | X Nonuniform density, white spots appeared | — |
| | o: Uniform density | o: Uniform image density<br>—: No experiment effected<br>o*: Uniform image density, but traces of cleaning blade appeared. |

Since acrylic resins E and G used in photosensitive drums E and G had each a low acid and acrylic resin K used in photosensitive drum K has a low molecular weight, dispersion of CdS in these resins was unsatisfactory and hence coating irregularities tend to be produced, thus resulting in nonuniform image density and local difference in the packing density of CdS.

Photosensitive drum C, because Tg of the binder resin used was as low as 20° C., was deficient in mechanical strength and hence susceptible to pressure of the blade edge, thus causing abnormal phenomena such as blade traces in images.

EXAMPLE 4

When photosensitive drums are prepared by a method, like Example 2, of coating an insulating layer on a photoconductive layer, the solvent used often remains and the durability under high humidity conditions may be deteriorated, if the drying temperature or time is inadequate. Accordingly, durability tests were conducted on the photosensitive drum of Example 2 and, as a comparative sample, on photosensitive drum X in Example 3, to examine effects of the drying temperature on the durability when the temperature is increased. In these tests, the durability was evaluated by measuring the potential retention when the same electrophotographic process as in the tests of Example 1 was repeated 600 times under environmental conditions of 25° C. and 100% RH and calculating the percentage ratio of potential retention of 600th charging to the first charging. The results are shown in Table 4.

TABLE 4

| Photosensitive drum | Drying temperature (°C.) 80 | 100 | 120 | 160 | 180 |
|---|---|---|---|---|---|
| Example 2 | 95% | 90% | 92% | 90% | 80% |
| X | 80% | 65% | 35% | | |

The photosensitive drum of Example 2 was not significantly deteriorated by increasing the drying temperature. Accordingly, the photosensitive drum can be stably produced. Photosensitive drum X, the comparative sample, was unstable to heat.

EXAMPLE 5

Image evaluation tests on the photosensitive drum of Example 2 by the pre-exposure NP process which comprises pre-exposure, primary positive DC charge, secondary DC discharging simultaneously with imagewise exposure, whole surface irradiation, dry development with a negative tononer, transfer, and cleaning treatment, indicated no significant variation in the transferred image density during continuous copying from restarting after charging and exposure were repeated successively 120,000 times or more and interrupted; thus constant images were produced.

EXAMPLE 6

As a result of applying the Carlson process to the photosensitive drum of Example 1, its durability including stability to environmental conditions was good.

EXAMPLE 7

Figure 5:
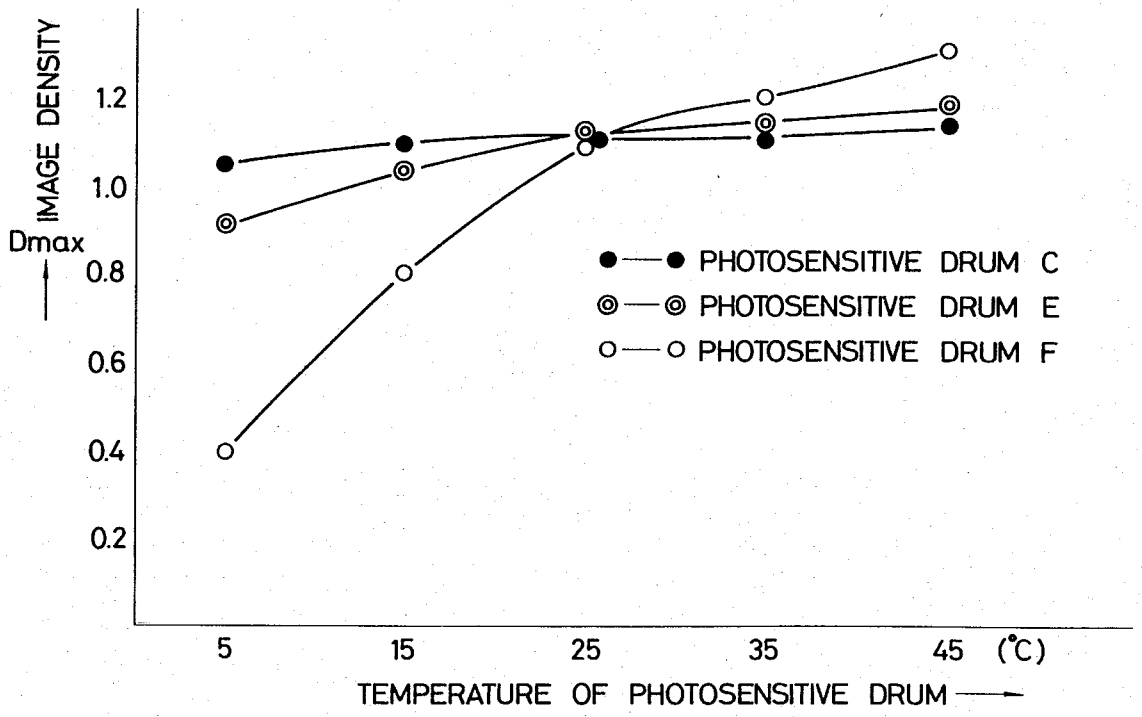
FIG. 5 is a graph showing the effect of temperature in heat-treatments of photosensitive drums on their image densities.

Photosensitive drums C, E, and F of Example 3 were subjected to the electrographic process as applied in Example 1. Image densities thus obtained and surface temperatures of the drums were measured. The results are shown in FIG. 5.

It was found that photosensitive drums employing lower Tg acrylic resins were less susceptible to temperature change (Tg: C 20° C., E 58° C., F 98° C.).

Synthesis Example 4

An acrylic copolymer resin was prepared by feeding 150 parts of toluene into a 500-ml 4-necked flask equipped with a cooling tube, stirrer, and thermometer, heating it to 110° C., adding styrene 20 parts, n-butyl methacrylate 60 parts, ethyl methacrylate 120 parts, methacrylic acid 14 parts, azoisobutyronitrile 5 parts and toluene 70 parts spending 2 hours under an inert gas atmosphere, and heating for further 6 hours. The resulting toluene solution of copolymer was found to have 50.5% of nonvolatile matter and a polymer acid value of 18.

Synthesis Example 5

The acrylic resins shown in Table 5 were prepared in the same manner as in Example 4.

TABLE 5

| Acrylic resin | Monomer composition (parts) n-BMA | MA | EMA | MMA | Acid* value | Tg | mol. wt. |
|---|---|---|---|---|---|---|---|
| L | 70 | 2 | | 30 | 4 | 40 | 38,000 |
| M | 60 | 7 | 10 | 30 | 12 | 41 | 30,000 |
| O | 70 | 10 | | 30 | 19 | 42 | 28,000 |
| P | 60 | 18 | 10 | 30 | 29 | 41 | 22,000 |
| Q | 80 | 25 | 3 | 20 | 45 | 42 | 15,000 |

*The acid values mean those of copolymers themselves.

EXAMPLE 8

A CdS powder (100 parts) and the acrylic resin of Synthesis Example 4 (40 parts) as a binder resin were dispersed by stirring and milled 3 times through a roll mill with a gap of 50μ. An Al cylindrical substrate was immersed in the above dispersion adjusted to a viscosity of 200 m pa.s by adding toluene, then was drawn up therefrom at the rate of 100 mm/min, and dried at 100° C. for 15 minutes to form a photoconductive layer of 35μ thick. A photosensitive drum was completed by winding a polyester film (the polyester layer being 25μ thick and the polyester layer being covered with an adhesive 5μ thick) around the resulting cylinder.

This photosensitive drum was tested by applying an electrophotographic process consisting of primary positive DC charge, secondary AC discharge simultaneously with imagewise exposure, whole surface irradiation, dry development with a negative toner, transfer, and cleaning treatment.

In the tests, consistency of image densities was examined during 80,000 or more repetitions of charging and exposure in a high humidity surrounding of 35° C. and 85% RH and during continuous copying from restarting after interruption of repeated charging and exposure. In both cases, the photosensitive drum gave copies of constant good image quality without being affected by humidity or repeated charging and exposure.

EXAMPLE 9

Figure 6:
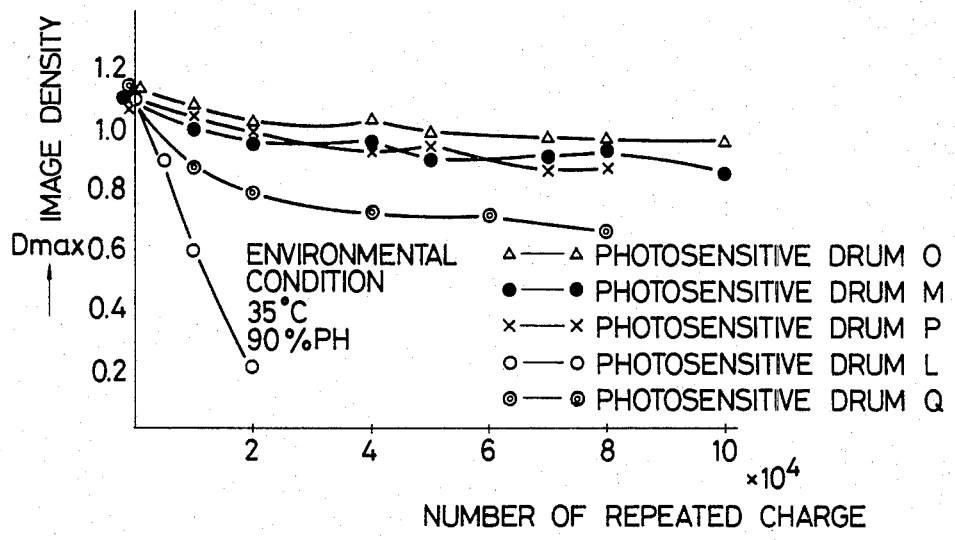
FIG. 6 is a graph indicating image density variations during durability tests on photosensitive drums prepared Example 9 in a high humidity surrounding.
Figure 7:
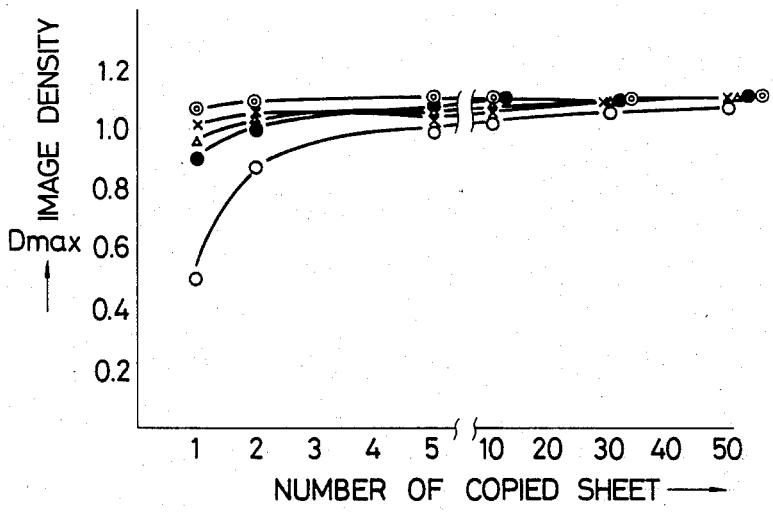
FIG. 7 is a graph indicating image density changes in continuous copying from restarting after interruption of repeated charging and exposure of photosensitive drums prepared in Example 9.

In the same manner as in Example 8, photoconductive layers were formed by using acrylic resins-L to Q in Synthesis Example 5 as binders. Each of the resulting photoconductive layer-coated cylinders was inserted into a shrinkable poly(ethylene terephalate) tube of 22μ thick (the same as used in Example 3), which was then shrinked to adhere to the photoconductive layer by heating for 15 minutes at 110° C., thereby forming an insulating layer of 20μ thick. Photosensitive drums L, M, O, P and Q prepared in this way were evaluated by measuring image density variations where they were repeatedly subjected, in a high humidity surrounding of 35° C. and 90% RH, to an electrophotographic process comprising pre-exposure, primary positive DC charge, secondary AC discharging simultaneously with imagewise exposure, whole surface irradiation, dry development with a negative toner, transfer, and cleaning treatment, and by measuring dark area image density (D max) during continuous copying from restarting after interruption of repeated charging and exposure. The results are shown in FIGS. 6 and 7. It was observed that the image density variaton was large when acrylic resins L, of low acid value, and Q, of high acid value were used.

EXAMPLE 10

A process comprising negative charge, imagewise exposure, and development was applied to photosensitive drums L to Q which were not covered with an insulating layer. Photosensitive drums M, O, and P indicated good durability under a high humidity surrounding (35° C., 90% RH).

What we claim is:

1. An electrophotographic photosensitive member which comprises a photoconductive layer comprising cadmium sulfide bonded with a binder resin, and an insulating layer laid on said photoconductive layer, characterized in that said binder resin is an acrylic resin not labile to moisture having a glass transition point of 15° to 70° C., an acid valve of 10 to 40, and a number average molecular weight of 10,000 or more.

2. An electrophotographic photosensitive member of claim 1, wherein the glass transition point is 40° to 60° C.

3. An electrophotographic photosensitive member of claim 1, wherein the acid value is 10 to 30.

4. An electrophotographic photosensitive member of claim 1, wherein the glass transition point is 20° to 58° C.

5. An electrophotographic photosensitive member of claim 1, wherein the acid value is 12 to 29.

6. An electrophotographic photosensitive member of claim 1, wherein the glass transition point is 20° to 58° C. and the acid value is 12 to 29.

* * * * *